United States Patent [19]

Cachat

[11] 4,122,321

[45] Oct. 24, 1978

[54] INDUCTION HEATING FURNACE

[75] Inventor: John F. Cachat, Cleveland, Ohio

[73] Assignee: Park-Ohio Industries, Inc., Cleveland, Ohio

[21] Appl. No.: 768,985

[22] Filed: Feb. 16, 1977

[51] Int. Cl.[2] ..... H05B 5/06

[52] U.S. Cl. ..... 219/10.41; 219/10.71; 219/10.79

[58] Field of Search ..... 219/10.41, 7.5, 10.67, 219/10.69, 10.71, 10.75, 10.79, 10.61, 10.43; 13/26; 266/124, 129

[56] References Cited

U.S. PATENT DOCUMENTS

| | | | |
|---|---|---|---|
| 2,618,734 | 11/1952 | Anderson | 219/10.67 |
| 2,902,572 | 9/1959 | Lackner et al. | 219/10.41 |
| 3,851,091 | 11/1974 | Laws | 219/10.69 |
| 4,054,770 | 10/1977 | Jackson et al. | 219/10.43 |

*Primary Examiner*—Bruce A. Reynolds
*Attorney, Agent, or Firm*—Meyer, Tilberry & Body

[57] ABSTRACT

An apparatus for heating an elongated workpiece having an elongated axis and moving along a heating path in a selected linear direction, the path having opposite sides defining a workpiece passage therebetween. This apparatus comprises a plurality of high permeability flux directing elements, each of the elements having a generally flat surface spaced from and generally parallel to the heating path, means for mounting the elements along at least one side of the path at selected, mutually spaced locations, separate coil means encircling each of said elements and alternating current power means for causing separate, spaced magnetic flux fields extending from said surfaces and into said passage in a direction generally perpendicular to said path.

2 Claims, 5 Drawing Figures

INDUCTION HEATING FURNACE

This invention relates to the art of induction heating and more particularly to an improved induction heating furnace for inductively heating elongated metal workpieces.

The invention is particularly applicable for inductively heating forging billets or elements to be heated to a processing temperature preparatory to subsequent forging or forming and it will be described with particular reference thereto; however, it is appreciated that the invention has much broader applications and may be used for inductively heating various elongated metal workpieces with relatively low frequency in the general range of 50–1,000 Hertz for various processing functions.

BACKGROUND OF INVENTION

In many forging installations, the elongated billets or metal workpieces used in forging operations are heated in a slot furnace having an elongated slot-like workpiece passageway through which the workpieces are fed in a transverse direction. As one workpiece is pushed sideways into the slot passageway, a heated workpiece is discharged from the exit end of the passageway. This type of furnace is generally heated with natural gas or oil by a series of flames both above and below the path followed by the workpiece through the passageway. As is well known, gas and oil are in short supply and alternative heating arrangements are being developed for various industrial installations. In this effort, it has been suggested that electrical resistance heaters be provided above and below the path of the workpiece to the workpiece passageway of a furnace as described above. These resistance heaters depend upon radiation for directing heat energy to the workpieces. Consequently, only the exposed surfaces of the workpieces are actually heated. Heat is then conducted internally of the workpieces from the heated surfaces. Such radiant heating is not uniform. In some instances, the center portions of the workpieces are not heated to the same degree as the outside surface portions. Thus, resistance heating units for using electricity instead of gas or oil has not been widely adopted in the forging field.

The present invention relates to a furnace which employs electrical power for heating workpieces passing along a given path through the workpiece receiving passageway of a furnace, as described above, without the disadvantages of previous resistance heating installations.

THE INVENTION

In accordance with the present invention there is provided an apparatus for heating an elongated workpiece having an elongated axis and moving along a heating path in a selected linear direction wherein the heating path has opposite sides defining a workpiece passageway therebetween. The apparatus in accordance with the invention comprises a plurality of high permeability flux directing elements, each of the elements having a generally flat surface spaced from and generally parallel to the heating path; means for mounting the elements along at least one side of the path at selected, mutually spaced locations; separate coil means encircling each of the elements; and, alternating current power means for causing separate, spaced magnetic flux fields extending from the surfaces of the elements and into the passageway in a direction generally perpendicular to the path of movement of the workpieces. In this manner, the elongated workpieces are heated by induction heating at spaced locations along their axial length. By using relatively low frequency in the general range of 50–1,000 Hertz, induction heating occurs to a relatively large depth into the workpieces. This provides directly heated portions of the workpiece. The heat energy is then conducted through the workpiece to cause temperature equilibrium in the workpiece so the workpiece is at a temperature above the subsequent processing temperature. This processing temperature may be in the general range of 1800–2400° F. when the subsequent processing is a forging operation.

In accordance with another aspect of the invention, the high permeability flux directing means are located on opposite sides of the heating path so that the workpiece is heated from opposite sides to further enhance the uniformity of the heating operation while still employing electrical induction heating principles. The elements are spaced from each other or the energizing coils are polarized in a manner which will not cause cancellation of flux fields between adjacent flux directing elements.

By using a plurality of induction heating fields, there is no need for a large inductor encircling the workpiece. Such an inductor can cause uneven heating of successive workpieces and can prevent effective use of a deep heating low frequency.

The primary object of the present invention is the provision of a furnace for heating moving, elongated workpieces, which furnace uses induction heating without surrounding the workpiece with an induction heating coil.

Another object of the present invention is the provision of a furnace, as described above, wherein the induction heating coil is spaced from the workpiece being heated.

Still a further object of the present invention is the provision of a furnace, as defined above, which furnace uses spaced flux fields for inductively heating the moving workpiece which does not cause undue magnetomotive forces on the workpieces.

Another object of the present invention is the provision of a furnace, as described above, which furnace includes a plurality of spaced, flux directing elements facing the moving workpiece for inductively heating selected, spaced portions of the workpiece as it moves past the flux directing elements.

Still a further object of the present invention is the provision of a furnace as defined above, which furnace is efficient in operation and easy to construct.

Another object of the present invention is the provision of a method of inductively heating a workpiece, which method inductively heats spaced portions of the workpiece as the workpiece is moving in a furnace.

These and other objects and advantages will become apparent from the following description.

BRIEF DESCRIPTION OF DRAWINGS

In this description, the following drawings are used for illustrative purposes.

PREFERRED EMBODIMENT

Figure 1:
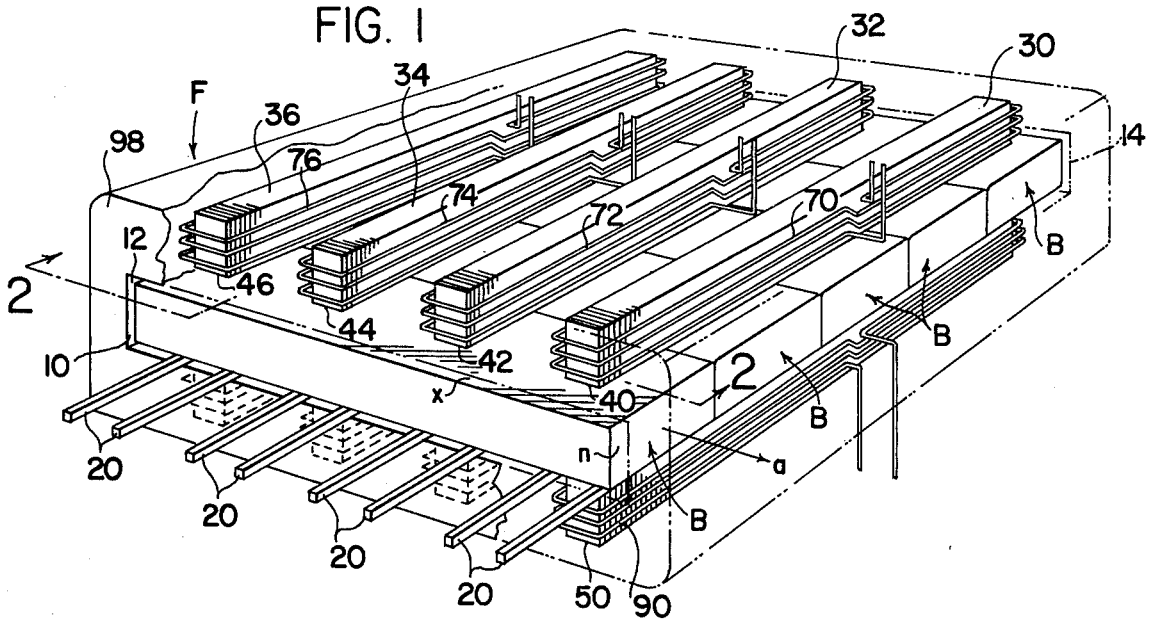
FIG. 1 is a schematic, partially cut-away pictorial view illustrating the preferred embodiment of the present invention.

Referring now to the drawings, wherein the showings are for the purpose of illustrating a preferred embodiment only, and not for the purpose of limiting the same, a furnace F is used to heat a series of elongated workpieces B which may be in the form of billets or other metal parts to be forged or hot formed after heating. Workpieces B are elongated in the general direction of axes *a* and include an upper surface *x*, a lower surface *y* and opposite ends *m, n*. Of course, a variety of workpieces could be heated in furnace F, which is of the type having an elongated slot defining a workpiece passageway 10 with an entrant end 12 and an exit end 14. In practice, workpieces B are fed through passage 10 in generally parallel, abutting relationship with a workpiece shifted laterally into entrant end 12 forcing a workpiece laterally from exit end 14 of passageway 10. An appropriate pusher means is provided at the entrant end for feeding the workpieces along a heating path P, best shown in FIG. 3. To support workpieces B as they move through passageway 10 along heating path P there is provided a plurality of axially spaced support rails 20 which are wear resistant and, preferably, nonmagnetic, such as stainless steel. As the workpieces progress through passageway 10, they are progressively heated to a final desired forging temperature, which may be in the general range of 1800° F.-2400° F. Of course, the final temperature of workpieces B can be controlled according to the desired final temperature for subsequent processing.

Figure 2:
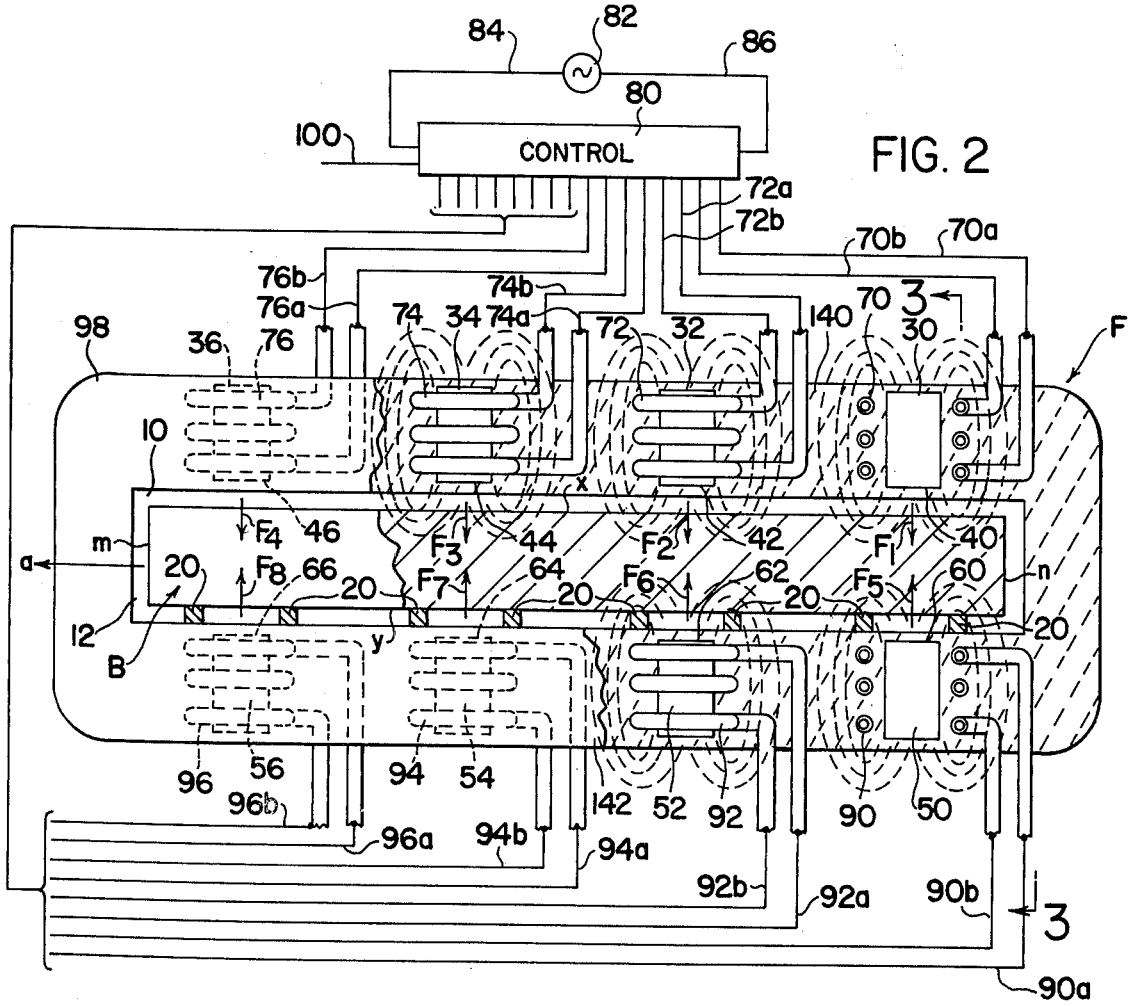
FIG. 2 is an enlarged, schematic front view of the preferred embodiment as illustrated in FIG. 1.

As best shown in FIGS. 1 and 2, a plurality of upper flux concentrating elements 30-36 are formed from high permeability material, such as iron laminations, and are arranged in generally parallel relationship in a direction corresponding to the direction of movement of workpiece B as they move along path P. Of course, the movement is preferably intermittent, although gradual, continuous movement could be employed. Elongated flux concentrating elements 30-36 extend generally perpendicular to the axes *a* of individual workpieces B and are supported above the upper surfaces *x* of the workpieces at selected, axially spaced locations with respect to the workpieces being heated. Each of the flux concentrating elements includes a lower generally flat pole surface 40, 42, 44, 46, respectively. These surfaces are elongated and are generally parallel to the upper surfaces of workpieces B at a selected distance above support rails 20 which may be water cooled. There is also provided lower flux concentrating elements 50-56 having basically the same structure as the upper flux concentrating elements 30-36 and including generally flat elongated surfaces 60, 62, 64, 66, respectively. An appropriate means is used for supporting elements 50-56 below surface *y* of workpieces B at axially spaced locations which, preferably, are between rails 20 to reduce any effect caused by the rails on the heating effect resulting from the flux field extending from lower elements 50-56. Generally flat surfaces 60-66 are parallel to surfaces 40-46 and are aligned with these surfaces as indicated in FIG. 2. By this mounting concept for elements 30-36 and 50-56, the elements are spaced somewhat equi-distant from workpieces B as the workpieces move through passageway 10.

In accordance with the present invention, separate coil means are provided for creating flux fields extending from upper and lower flux concentrated elements. These flux fields will extend into passageway 10 and intersect workpieces B for inductively heating axially spaced locations on the workpieces as the workpieces are moving through furnace F. In the illustrated embodiment, coil means 70-76 encircle, in the elongated direction, upper flux concentrating element 30-36. Leads **70*a*, 70*b*, 72*a*, 72*b*, 74*a*, 74*b*, 76*a* and 76*b* interconnect coil means 70-76 with appropriate alternating current control device 80 powered by an alternating current power supply, schematically represented as alternator or generator 82. In accordance with the invention, the alternating current power supply energizes coil means 70-76 with current having a frequency in the general range of 50-1,000 Hertz and preferably in the general range of 50-500 Hertz. Power supply 82 is connected to control 80 by appropriate means schematically illustrated as leads 84, 86. Thus, the alternating power supply energizes the individual coils 70-76 to create flux fields having central axes labeled $F_1$-$F_4$ in FIG. 2. The central axes of these flux fields are generally perpendicular to the upper surface of workpieces B and induce voltages into surface portions directly below surfaces 40-46. Current flows created by voltages induced into the workpieces cause heating in axially spaced areas directly under surfaces 40-46 as workpieces B move along path P. In a like manner, coil means 90-96 encircle lower flux concentrating elements 50-56 in an elongated direction and are connected to control 80 by appropriate leads schematically illustrated as leads 90*a*, 90*b*, 92*a*, 92*b*, 94*a*, 94*b*, 96*a*, and 96*b*. These leads energize coil means 90-96 for creating flux fields having axes generally represented by axes $F_5$-$F_8$ in FIG. 2**. It is noted that the flux fields $F_1$-$F_4$ and $F_5$-$F_8$ are generally aligned in a vertical direction and are axially spaced along the upper and lower surfaces of workpieces B.

Figure 3:
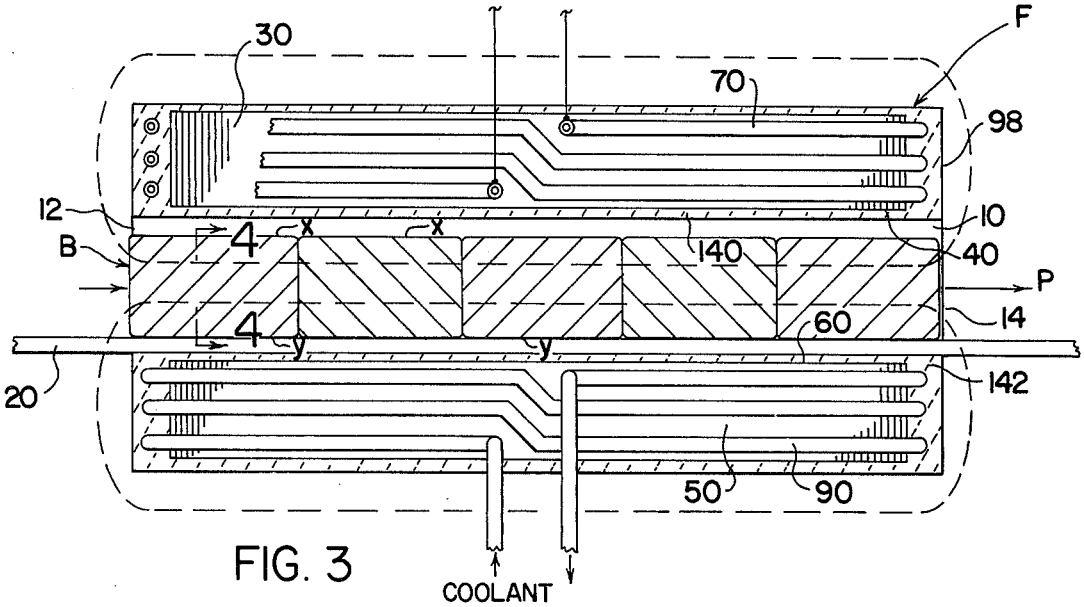
FIG. 3 is a cross-sectional view taken generally along line 3—3 of FIG. 2.

In practice, furnace F includes a housing 98 which mounts elements 30-36, elements 50-56, coil means 70-76 and coil means 90-96 in the space relationship as shown in FIGS. 1-3. Housing 98 is illustrated as including an encapsulating struture which is also reinforced to provide structural stability for furnace F so that it may be used for long range operation in a billet heating installation. Although not necessary, a plurality of thermocouples 100 schematically illustrated in FIG. 4 may be employed to indicate the heating effect at various locations in the vicinity of the exit end 14 of passageway 10. As temperature differences are detected, control 80 is adjusted to vary the amount of energy supplied to the various coil means for creating flux fields $F_1$-$F_8$. Of course, control 80 could discontinue operation of the various coil means if overheating is noted in a certain area of the workpieces progressed through passageway 10. The particular type of control for the workpieces is not essential to the present invention. The basic concept of the invention does not require any type of control except to direct a preselected adjusted amount of energy into the moving workpieces. This energy is coordinated with the speed of the workpiece feeding operation to control final workpiece temperature.

Figure 4:
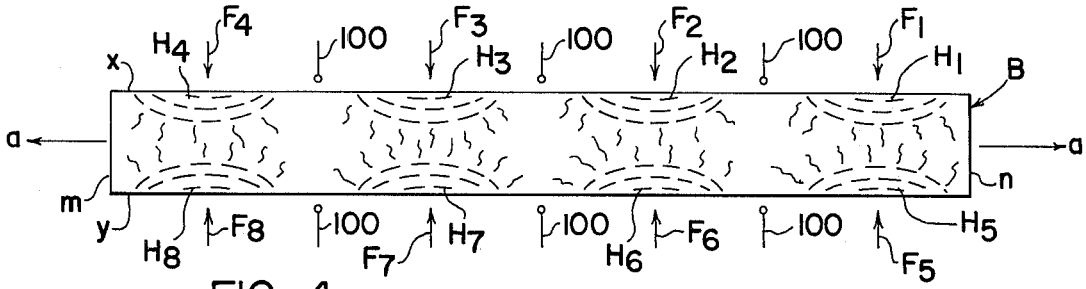
FIG. 4 is a side elevational view of a workpiece as shown in FIGS. 1-3 illustrating the heating concept of the metal workpiece; and, FIG. 5 is a schematic diagram illustrating a modification of the preferred embodiment of the invention.

Referring now to FIG. 4, flux fields $F_1$-$F_8$ are schematically illustrated as creating induction heating portions $H_1$-$H_8$ directly opposite the generally flat facing surfaces of the separate flux concentrating elements. These heated portions $H_1$–$H_8$ of a workpiece B are heated by induction heating principles, whereas the intermediate mass of the workpiece is heated by heat energy conduction from the axially spaced inductively heated portions.

In practice, the metal of workpieces B is steel which is to be subsequently forged or formed at high or elevated temperatures. As the workpiece B progresses through passageway 10 of furnace F, the inductively heated portions are directly heated by the flux fields $F_1$–$F_8$. These flux fields cause generally spaced heated portions along surfaces *x, y*. Of course, these heated portions may overlap even though the flux fields $F_1$–$F_8$ do not overlap. In other words, the upper and lower elements are spaced axially from each other a distance which prevents interaction between the flux fields of the energizing coil means and the adjacent flux concentrators. In this manner, separate and distinct, axially spaced flux fields are used for inductively heating the upper and lower surfaces of workpieces B. In some instances, it may be possible to employ heating adjacent one workpiece surface; however, in practice both surfaces are inductively heated by relatively low frequency for deep heating at axially spaced portions along the workpiece for uniform and rapid heating of workpiece B.

Figure 5:
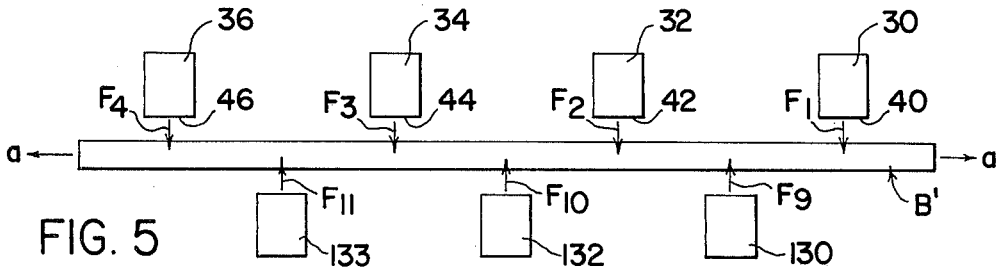

Referring now to FIG. 5, there is a schematic illustration of a modified furnace wherein lower flux concentrating elements 130, 132 and 133 are provided with appropriate coil means to create flux fields $F_9$, $F_{10}$, $F_{11}$, respectively. These flux fields are identified by their center axes and are mounted below the workpiece B′ at locations axially intermediate and preferably midway between the locations of upper flux directing elements 30-36. In this manner, the lower surface heating is accomplished at axially spaced locations between the heated locations used at the upper surface of workpiece B′. This process may be used when relatively thin workpieces are being processed by furnace F, and/or when relatively low frequency is being employed. Low frequency provides relatively deep heating which may allow uniform heating at axially spaced, staggered locations as schematically illustrated in FIG. 5.

In some instances, the flux concentrating elements may be generally cylindrical in nature and encircled by appropriate coil means for directing vertical, spaced flux fields into passageway 10; however, the elongated pole structure, as illustrated in the preferred embodiment, is used for better uniformity and control of the heating operation. By using the present invention, the coil means for creating the induction heating energy is spaced substantially away from the heated workpiece. Thus, the separate coil means are subjected to lesser heat. In addition, the coils may be water cooled by internal passages for liquid coolant as schematically illustrated in FIG. 3. In this manner, longer life of the heating elements can be realized than would be possible if the induction heating was caused by closely spaced induction heating coils wrapped around workpieces B as they are moving through the furnace F. Thus, by providing spaced and thermally isolated coil means for energizing furnace F, longer coil life is realized and induction heating can be adapted for use in a furnace of the general type having an internal slot for transversely feeding elongated workpieces. The thermal insulation of the coil means may be by ceramic material 140, 142, as shown in FIG. 3.

Having thus described the invention, it is claimed:

1. A furnace for heating a series of elongated workpieces each having an elongated axis and moving in axially parallel relationship along a heating path in a selected linear direction generally transverse to said workpieces and generally parallel with said path, said furnace comprising: a plurality of upper and lower, elongated, high permeability flux directing elements, said elements being independent of each other, each of said elements having an elongated generally flat pole surface extending in a direction parallel to said linear direction and facing said heating path; means for mounting said upper elements above said path at selected first locations spaced selected distances in a direction axially of said workpieces; means for mounting said lower elements below said path at selected second locations spaced selected distances in a direction axially of said workpieces; separate coil means encircling each of said elements in the longitudinal direction thereof; alternating current power means for energizing each of said coil means independently to cause separate mangetic flux fields for each of said pole surfaces, said fields extending from said pole surfaces of said elements perpendicularly into said path and each field entering and leaving the workpieces from one side of said path independently of the other flux fields; and, means for independently controlling said power means for each of said coil means and thereby the flux field thereof.

2. The method of heating opposite sides of an elongated metal workpiece as it is moved transversely through a predetermined path of travel, said method comprising the steps of:

(a) creating a number of separate, independent and variable strength magnetic flux fields spaced across and on opposite sides of said path and having generally parallel axes normal to said path, said flux fields alternating in polarity at a rate in the general range of 50–1,000 alterations per second;

(b) passing said workpiece transversely through said flux fields to cause the fields on respective sides of the workpiece to each enter and leave the adjacent one of the surfaces thereof and inductively heat the workpiece at axially spaced portions on each side thereof;

(c) allowing said flux fields to heat the said axially spaced portions on opposite sides of said workpieces for conduction of heat energy through said workpiece; and, (d) varying the strength of said flux fields to control the temperature of said workpiece.

* * * * *